US008376650B2

(12) United States Patent
Hild et al.

(10) Patent No.: US 8,376,650 B2
(45) Date of Patent: Feb. 19, 2013

(54) BOLLARD ASSEMBLY

(75) Inventors: Brent Hild, Belmont, MA (US); Thomas C. Fitch, Somerville, MA (US); Teodoro A. Mesa, Lynn, MA (US); David S. McCue, Manchester, MA (US)

(73) Assignee: McCue Corporation, Salem, MA (US)

( * ) Notice: Subject to any disclaimer, the term of this patent is extended or adjusted under 35 U.S.C. 154(b) by 49 days.

(21) Appl. No.: 13/076,821

(22) Filed: Mar. 31, 2011

(65) Prior Publication Data

US 2012/0251236 A1 Oct. 4, 2012

(51) Int. Cl.
*E01F 9/011* (2006.01)

(52) U.S. Cl. ..... 404/6; 404/9; 404/10

(58) Field of Classification Search ..... 404/6, 9, 404/10; 256/13.1
See application file for complete search history.

(56) References Cited

U.S. PATENT DOCUMENTS 4,297,050 A * 10/1981 Gmelch ..... 404/10
4,511,281 A * 4/1985 Schmanski ..... 404/10
4,515,499 A * 5/1985 Furiate ..... 404/6
5,809,733 A * 9/1998 Venegas, Jr. ..... 52/835
6,514,006 B1 * 2/2003 Hines ..... 404/9
6,516,573 B1 * 2/2003 Farrell et al. ..... 52/98
6,719,484 B1 * 4/2004 Johnson ..... 404/10

OTHER PUBLICATIONS

"Car Park Bollards," Retrieved from Internet: www.mccue.com, Apr./May 2012 (2 pages).

* cited by examiner

*Primary Examiner* — Raymond W Addie
(74) *Attorney, Agent, or Firm* — Occhiuti Rohlicek & Tsao LLP

(57) ABSTRACT

A bollard assembly is disclosed that includes an elongate hollow bollard having opposed first and second ends, a sidewall extending between the first and second ends, and through hole formed in the side wall. The assembly also includes a sleeve configured to receive and support a lower portion of the bollard, and a hollow cylindrical insert disposed within the lower end of the bollard. A pin protrudes outward from the insert sidewall, extends through the bollard through hole and engages the sleeve, whereby the assembly is retained in an assembled configuration. The bollard includes a prescribed breakaway line along which an upper portion of the bollard can be separated from the lower portion upon sufficient impact. Once the upper portion is broken away, the insert permits the lower portion of the bollard to be removed from the sleeve and replaced with a replacement bollard.

19 Claims, 5 Drawing Sheets

BOLLARD ASSEMBLY

BACKGROUND OF THE INVENTION

A bollard is a protective barrier that is used to protect structures from collisions, to control access to certain areas and/or to direct a flow of traffic. Depending on the particular application, a bollard may be plate-mounted or mounted via core-drilling. Plate-mounted bollards are typically used in less demanding applications such as an in-store environment in which a bollard is used to protect product display cabinets. Plate-mounted bollards include a steel plate and a bollard. extending perpendicularly from one face of the plate. The plate sits on the surface of the floor and bolts are used to fasten the plate, and therefore the bollard, to the floor. For this type of bollard, there is no significant disruption to the ground or floor, other than the bolt holes, which are in some instances pre-drilled. On the other hand, core-drilled bollards are typically used in higher impact applications such as protecting a loading dock from heavy vehicles, and are generally permanently mounted to the ground by embedding a portion of the bollard in a concrete-filled hole. Installation of a core-drilled bollard is significantly more expensive than for a plate-mounted bollard, and takes significantly more time. Once installed, core-drilled bollards can be difficult to replace when damaged. However, despite these disadvantages, there are applications which required a core-drilled bollard due to its ability to absorb large impact loads.

SUMMARY

In some aspects, a bollard assembly includes a hollow bollard having a first end, second end opposed to the first end, a sidewall extending between the first end and the second end, and a through hole formed in the side wall, a sleeve including an interior surface, the sleeve configured to enclose a portion of the bollard sidewall, and an insert having an insert sidewall, and a pin protruding outward from the insert sidewall, the insert disposed within the first end of the hollow bollard with the pin extending through the bollard through hole. The sleeve is disposed on the first end of the bollard with the pin engaged with the sleeve interior surface.

The bollard assembly may include one or more of the following features: The bollard sidewall further comprises a prescribed breakaway line along which a portion of the bollard is configured to separate from the remainder of the bollard upon application of a sufficient load to the portion. The breakaway line is an annular portion of the bollard sidewall formed to be relatively weak when compared to the remainder of the bollard sidewall. The breakaway line comprises an annular groove formed in the bollard sidewall. The breakaway line is located between the first end of the bollard and a point disposed mid way between the first and second ends of the bollard. The sleeve includes a sleeve first end, and a sleeve second end opposed to the sleeve first end, and the first end of the sleeve is aligned with the breakaway line. The sleeve has a sleeve first end, a sleeve second end, and an axial length determined by the distance between the sleeve first end and sleeve second end, and the distance of the breakaway line from the bollard second end is greater than or equal to the sleeve axial length.

The bollard assembly may include one or more of the following additional features: The sleeve includes a sleeve sidewall having a concavity configured to receive the insert pin, and when the pin protrudes through the bollard through hole and is received within the concavity, the pin engages the sleeve, and the bollard, sleeve, and insert are substantially prevented from relative movement. The pin is configured to move relative to the insert in a direction generally transverse to a longitudinal axis of the insert, whereby the pin can be selectively retracted from engagement with the sleeve interior surface. The insert includes a key hole configured to receive a pin retracting tool. The insert further includes a resilient member configured to bias the insert pin in a radially outward direction. The bollard is tapered in the vicinity of the first end. The bollard is tapered between the prescribed breakaway line and the first end such that the outer diameter of the bollard at the breakaway line is greater than the outer diameter of the bollard at the first end. The insert further includes a stop member configured to limit the extent to which the insert is inserted within the bollard. The insert further includes a first end and a second end opposed to the first end, the second end including an outwardly protruding peripheral flange, the flange having an outer diameter that corresponds to the outer diameter of the bollard first end. The insert includes a handle configured to permit the insert to be grasped and withdrawn from the sleeve. The sleeve is a hollow, generally cylindrical body having an open first end, a closed second end, and a sidewall extending between the first and second ends, the sidewall including an outwardly protruding circumferential bead.

In some aspects, the bollard assembly includes a hollow bollard having a bollard sidewall and a through hole formed in the sidewall, and an insert having an insert sidewall, and a pin protruding outward from the insert sidewall. The insert is disposed within the bollard with the pin extending through the bollard through hole.

The bollard assembly may include one or more of the following features: The bollard further includes a sleeve. The sleeve includes an interior surface and is configured to enclose a portion of the bollard sidewall, and the sleeve is disposed on an end of the bollard with the pin engaged with the sleeve interior surface. The pin is retractable relative to the insert sidewall. The insert includes a key hole configured to receive a pin-retracting tool. The sleeve includes a sleeve sidewall, and a concavity formed in an inner surface of the sleeve sidewall, the concavity configured to receive the pin such that when the pin is received within the concavity, the pin engages the sleeve and the bollard, insert and sleeve are substantially prevented from relative movement.

The bollard assembly may include one or more of the following additional features: The bollard sidewall further comprises a prescribed breakaway line along which a portion of the bollard is configured to separate from the remainder of the bollard upon application of a sufficient load to the portion. The breakaway line is an annular portion of the bollard sidewall formed to be relatively weak when compared to the remainder of the bollard sidewall. The breakaway line comprises an annular groove formed in the bollard sidewall. The breakaway line is located between a point disposed mid way between opposed ends of the bollard and one of the opposed ends of the bollard. The sleeve includes a sleeve first end, and a sleeve second end opposed to the sleeve first end, and the first end of the sleeve is aligned with the breakaway line. The sleeve has a sleeve first end, a sleeve second end, and an axial length determined by the distance between the sleeve first end and sleeve second end, and the distance of the breakaway line from one of the opposed ends of the, bollard is greater than or equal to the sleeve axial length.

Among other advantages, the bollard assembly is a core-drilled type bollard for use in relatively high impact applications. The assembly includes a hollow bollard having a sidewall and through hole formed in the side wall, a sleeve including an interior surface configured to enclose a portion of the bollard sidewall, and an insert having a pin protruding outward from the insert sidewall. When assembled, the insert is disposed within the bollard with the pin extending through the bollard through hole, and the sleeve is disposed on the bollard sidewall with the pin engaged with the sleeve interior surface. By this feature the bollard can be quickly and easily installed in the sleeve.

The bollard has a breakaway feature that permits an upper portion of the bollard to break away from the installed lower portion, insert and sleeve upon sufficient impact. Since a portion of the bollard breaks away upon impact, damage to vehicles is minimized.

The bollard is designed so that breakaway occurs at a location that is even with the ground so that the lower portion does not provide a tripping hazard after breakaway of the upper portion. In addition, after breakaway, the top of the insert is exposed, whereby the lower portion and insert combine to provide a flat surface that is generally flush with the ground. This is much safer and more aesthetically pleasing than would occur if a conventional hollow bollard were broken, potentially creating a tripping hazard and/or a hole in the ground.

The insert maintains the lower portion of the bollard within the sleeve after breakaway of the upper portion of the bollard, and permits the lower end of the bollard to be easily and quickly withdrawn from the sleeve after breakaway of the upper portion, so that a replacement bollard can be quickly easily installed in the original sleeve.

Modes for carrying out the present invention are explained below by reference to an embodiment of the present invention shown in the attached drawings. The above-mentioned object, other objects, characteristics and advantages of the present invention will become apparent from the detailed description of the embodiment of the invention presented below in conjunction with the attached drawings.

DETAILED DESCRIPTION

Figure 1:
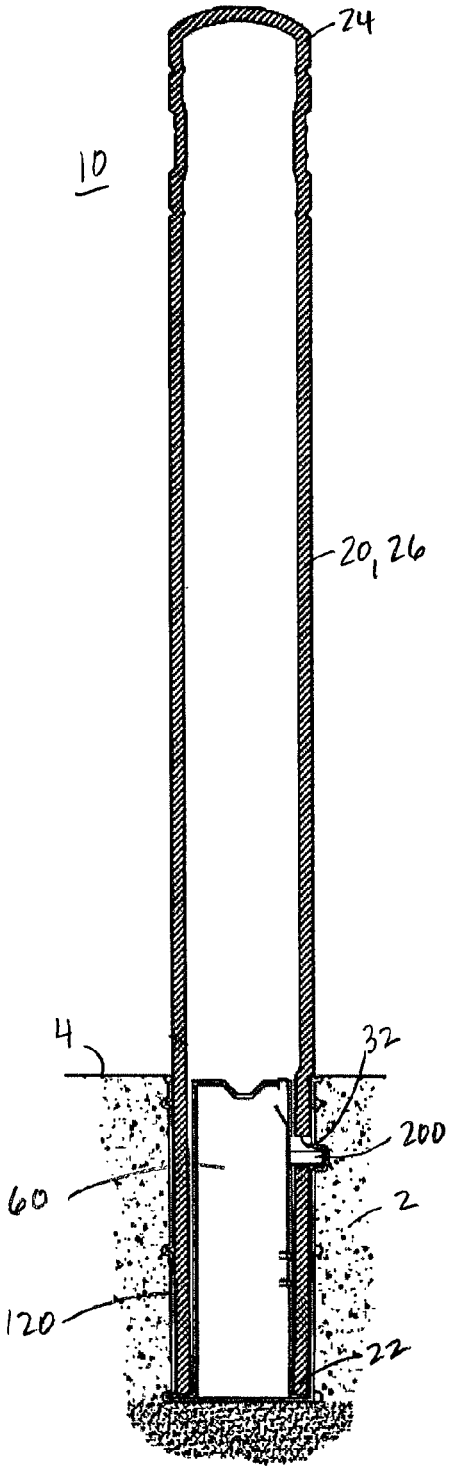
FIG. 1 is a sectional view of the bollard assembly installed in the ground.

Referring now to FIGS. 1-5, a bollard assembly 10 includes an elongate hollow bollard 20 having a first end 22, a second end 24 opposed to the first end, a sidewall 26 extending between the opposed ends 22, 24, and through hole 32 formed in the side wall 26. The bollard assembly 10 includes a sleeve 120 configured to receive and support a first portion 36 of the bollard 20, where the first portion 36 includes the first end 22 of the bollard 20. In addition, the bollard assembly 10 includes a hollow cylindrical insert 60 disposed within the bollard first portion 36. In use, the sleeve 120 is permanently embedded in the ground 2, and the first portion 36 of the bollard 20, with the insert 60 positioned therein, is placed in the sleeve 120 (FIG. 1). A pin 200 protrudes outward from the insert 60, extends through the bollard through hole 32 and engages the sleeve 120, whereby the bollard assembly 10 is retained in an assembled configuration. The bollard 20 includes a prescribed breakaway line 34 (FIGS. 2 and 3) along which the remaining second portion 38 of the bollard 20 can be separated from the first portion 36 upon sufficient impact to the second portion 38. Once the second portion 38 has been broken away from the first portion 36 (FIG. 2), the insert 60 permits the bollard first portion 36 to be removed from the sleeve 120 and replaced with a replacement bollard. These and other features will be discussed in detail below.

Figures 3, 4, 5:
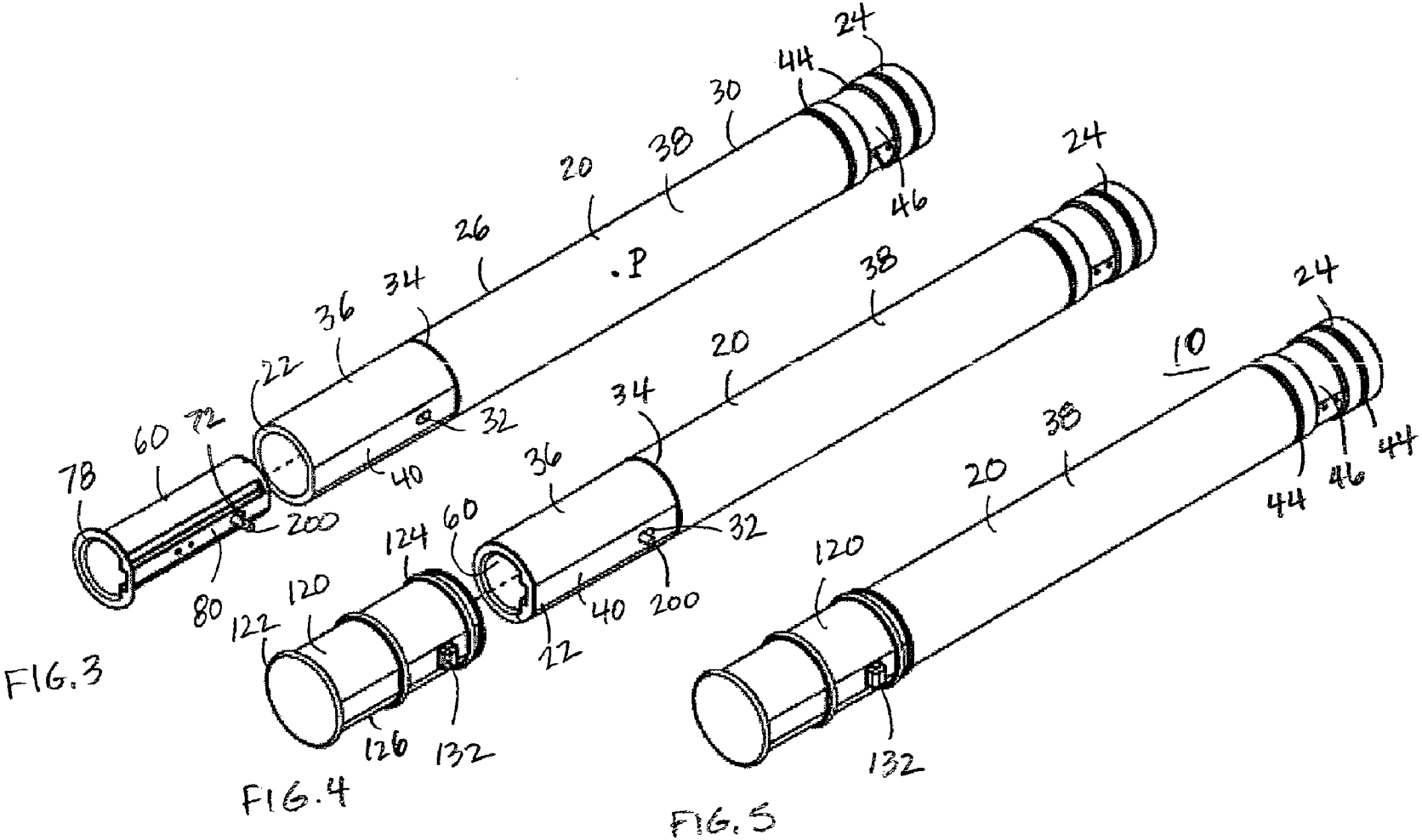
FIG. 3 is a perspective exploded view of the insert and bollard of the bollard assembly of FIG. 1.
FIG. 4 is a perspective exploded view of the sleeve and bollard, where the bollard is pre-assembled with the insert, of the bollard assembly of FIG. 1.
FIG. 5 is a perspective view of the assembled bollard assembly of FIG. 1.

Referring in particular to FIG. 3, the bollard 20 is an elongate hollow, generally cylindrical structure in which the first end 22 is open, and the second end 24 is closed. In the illustrated embodiment, the second end 24 is convex to promote shedding of rain and snow and to prevent the accumulation of debris. The sidewall 26 that extends between the first end 22 and the second end 24 is thin relative to a diameter of the bollard. For example, in some embodiments, the bollard sidewall thickness may be 0.5 inches, the diameter of the bollard 20 may be 5 inches, and a length from first to second ends 22, 24 may be 51 inches.

The bollard 20 may be formed of a tough, rigid plastic such as, but not limited to, high density polyethylene, low density polyethylene, medium density polyethylene or polypropylene. The outer surface 30 may include surface features that enhance aesthetics and bollard visibility. For example, in the illustrated embodiment, in the vicinity of the bollard second end 24, the outer surface 30 includes decorative grooves 44, as well as a light-reflective region 46.

Figure 8:
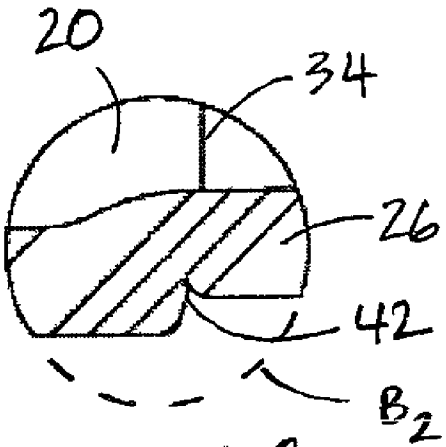
FIG. 8 is an enlarged detail view of the area B2 of FIG. 6 showing the V shaped groove on the flat portion of the bollard first end.
Figure 7:
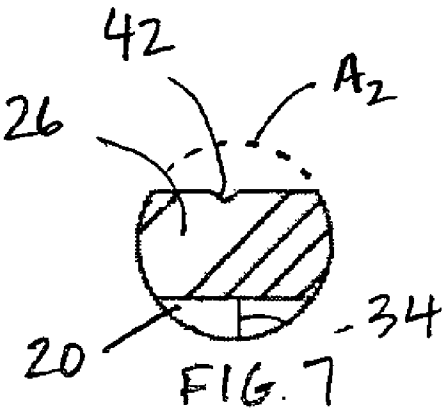
FIG. 7 is an enlarged detail view of the area A2 of FIG. 6 showing the V shaped groove on the cylindrical portion of the bollard first end.
Figure 6:
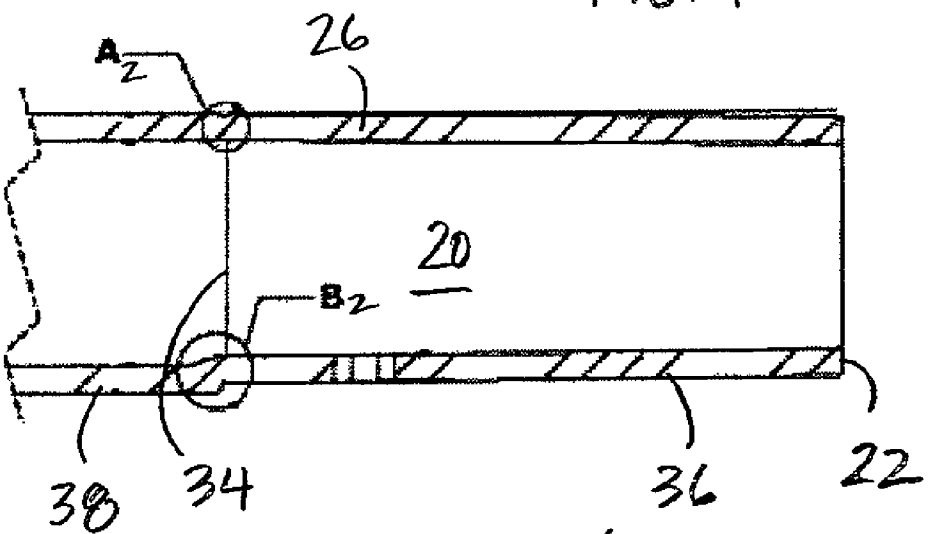
FIG. 6 is a side sectional view of the first portion of the bollard of FIG. 1.
Figure 11:
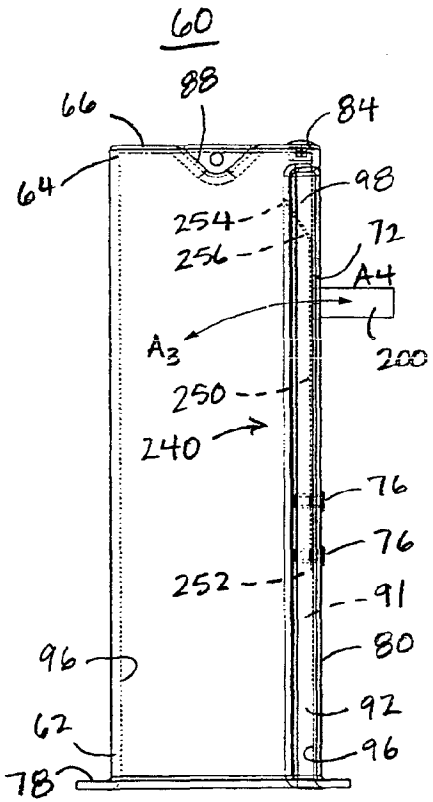
FIG. 11 is a side view of the insert of FIG. 9 as seen in the direction of arrow C.
Figure 10:
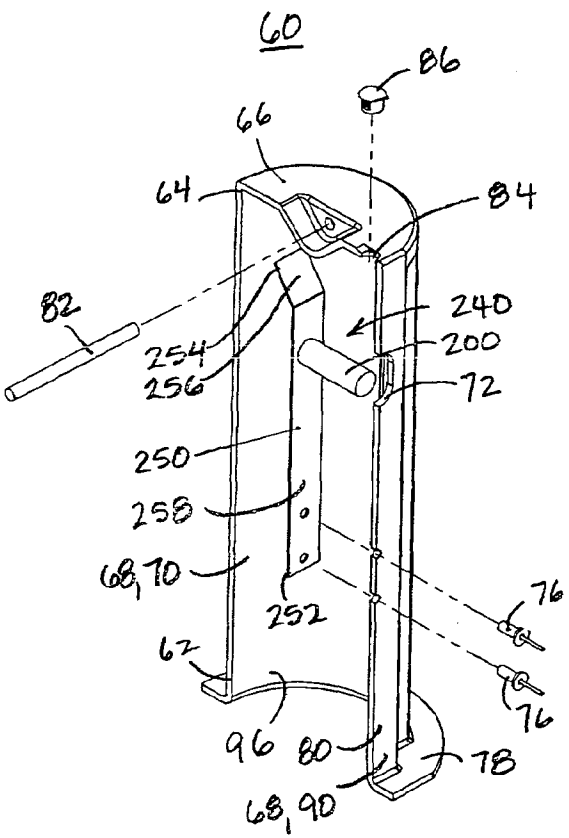
FIG. 10 is a cut-away, exploded perspective view of the insert of FIG. 9.
Figure 9:
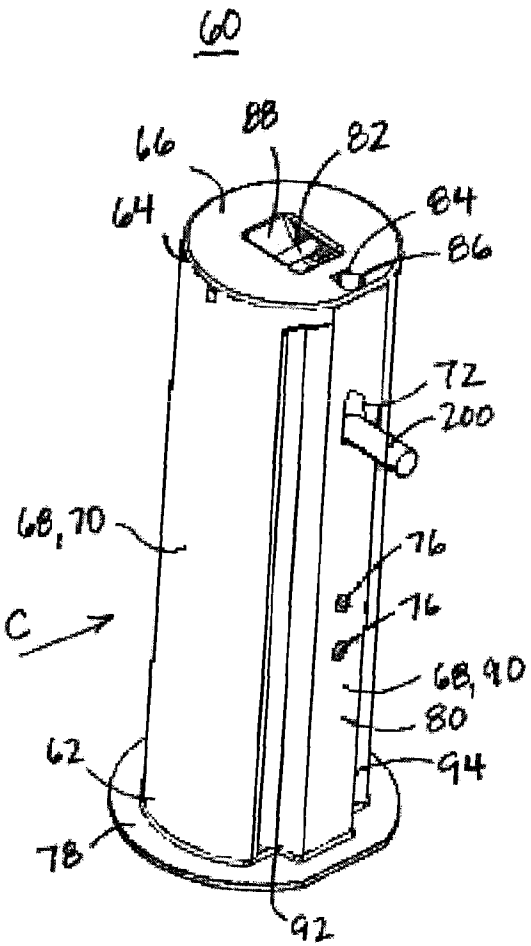
FIG. 9 is a perspective view of the insert of FIG. 1.

Referring also to FIGS. 6-8, the prescribed breakaway line 34 is an annular region of the bollard sidewall 26 that is formed to be relatively weak when compared to the remainder of the bollard sidewall 26. In particular, the breakaway line 34 is a circumferentially-extending V-shaped groove formed in the bollard sidewall 26. The breakaway line 34 is located between the first end 22 of the bollard 20 and a point P disposed mid way between the first and second ends 22, 24 of the bollard 20. In the illustrated embodiment, the first portion 36, defined as the region between the breakaway line 34 and the first end 22, has a length of approximately 25 percent of overall bollard length. In some embodiments, the bollard 20 is designed so that the breakaway line 34 is located at the ground surface so that the bollard 20 will break level with the ground. By doing so, creation of a tripping hazard is avoided.

The first portion 36 of the bollard 20 is formed having a flat region 40 that extends axially between the breakaway line 34 and the first end 22. The bollard through hole 32 is formed in the flat region 40 at a location adjacent to the breakaway line 34. During assembly of the insert 60 within the bollard 20, the bollard flat region 40 provides registration with a corresponding insert flat region 80 (described below) so that the insert pin 200 is easily aligned with the bollard through hole 32. In addition, the first portion 36 of the bollard 20 tapers slightly from the breakaway line 34 to the first end 22 such that the cross-sectional dimension of the bollard 20 at the breakaway line 34 is larger than the corresponding cross-sectional dimension of the bollard at the first end 22. The slight inward tapering of the first portion 36 facilitates insertion of the first portion 36 into the sleeve 120 during assembly, and also facilitates withdrawal of the first portion 36 from the sleeve during replacement.

Referring to FIGS. 3 and 9-11, the insert 60 is hollow, generally cylindrical structure including an open first end 62 and a closed second end 64. The closed second end face 66 of the insert is flat, and includes a centrally located cavity 88. The cavity 88 is generally v-shaped in section, and serves to support a handle 82 at a location that is recessed relative to the second end face 66. The handle 88 is a rod that extends between opposed sides of the cavity 88. The second end face 66 also includes a key hole 84 positioned between the cavity 88 and the peripheral edge of the second end face 66. Moreover, the key hole 84 is located on the second end face 66 at a location that corresponds to the insert flat portion 80, for reasons discussed below. A removable plug 86 is press-fit into the key hole 84 to prevent debris from passing through the key hole 84 and into the insert interior.

The first end 62 of the insert 60 includes a radially outward-extending flange 78 that surrounds the periphery of the first end 62. The outer diameter of the insert 60 is selected to be slightly less than the inner diameter of the bollard first end 22 so that the insert 60 can be inserted into the hollow interior space of the bollard first portion 36. The flange 78 has an outer diameter that corresponds to the outer diameter of the bollard first end 22, and serves as a stop so that when the second end 64 of the insert 60 is inserted into the bollard first end 22, the flange 78 abuts the bollard first end 22 and prevents the insert 60 from passing inward beyond the bollard first portion 36.

The insert 60 includes a sidewall 68 that extends between the insert first and second ends 62, 64. The sidewall 68 includes a generally cylindrical portion 70 and a channel portion 90. The channel portion 90 is U-shaped in cross section, and as such includes a flat base that corresponds to the insert flat portion 80, and flat legs 92, 94 that extend transverse to the flat portion 80 and join the channel portion 90 to the cylindrical portion 70 of the sidewall 68. In particular, the legs 92, 94 protrude inward relative to an arc defined by the outer diameter of the cylindrical portion 70. As a result, the legs 92, 94 and flat portion 80 define an axially-extending channel 91 on the inner surface 96 of the insert 60.

The insert 60 also includes a quick-release locking mechanism 240 which retains the bollard 20, insert 60 and sleeve 120 in the assembled configuration shown in FIGS. 1 and 5. The quick-release locking mechanism 240 is disposed in the channel 91 and includes a resilient plate 250 and a pin 200 that protrudes from the plate 250. The plate 250 is a thin, elongated rectangle in shape, and has a first end 252, and a second end 254 that is opposed to the first end 252. The pin 200 extends from a surface 258 of the plate 250 that faces the insert inner surface 96, and is located between the second end 254 of the plate 250 and a midpoint between the first and second ends 252, 254. The first end 252 is fixed to the insert inner surface 96 at the insert flat portion 80, for example by using rivets 76, so that the pin 200 protrudes through the pin through hole 72.

The second end of the plate 250 includes art angled portion 256. The angled portion 256 is angled away from the insert inner surface 96 so that a space 98 exists between the second end 254 of the plate 250 and the insert inner surface 96. The locking mechanism 240 is arranged within the channel portion 90 so that the angled portion 256 is located below and underlies the keyhole 84.

Figure 12:
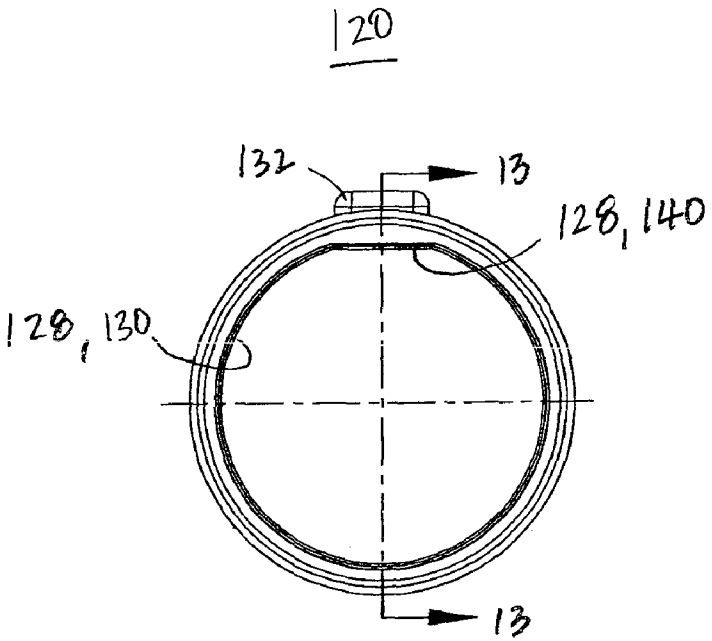
FIG. 12 is an end view of the open end of the sleeve of FIG. 1.

The plate 250 serves as a resilient spring that biases the pin so as to protrude through the pin through hole 72, and may be formed of, for example, spring steel. The pin 200 can be retracted from the insert through hole 72 by application of a radially inward force along an axis defined by the pin 200, or by application of a downward force on the angled portion 256 of the plate 250. In the latter, pin retraction is achieved by passing a key (not shown) through the key hole 84 and downward along the angled portion 256, whereby the plate 250 is caused to bend so that the angled portion 256 is moved away from the insert inner surface 96 as illustrated in FIG. 12 by the arrow A3. As a result, the pin 200 can be retracted from the through hole 72 and into the interior space of the insert 60, thereby releasing the insert 60 from the bollard 20 and/or releasing the bollard 60 from the sleeve 120. Upon withdrawal of the key, the plate 250 is released and resiliently returns to its original configuration along the direction of arrow A4.

Figure 13:
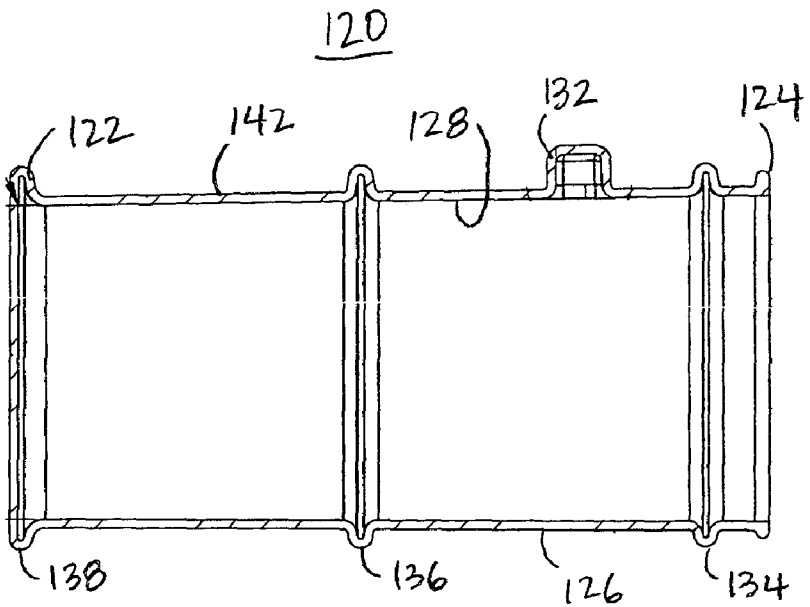
FIG. 13 is a side sectional view of the sleeve as seen along line 13-13 of FIG. 12.

Referring to FIGS. 4 and 12-13, the sleeve 120 is a hollow, generally cylindrical structure that includes an open first end 124, a closed second end 122 opposed to the first end 124 and a sidewall 126 that extends between the first and second ends 122, 124. The interior surface 128 of the sleeve 120 includes a cylindrical portion 130 and a flat portion 140, each arranged to mirror the corresponding features of the bollard 20. In addition, the sleeve interior surface 120 includes a concavity 132 located on the flat portion 140. As a result, during assembly, the bollard flat portion 40 must register with the sleeve flat portion 140. Since the insert flat portion 80 is also registered with the bollard flat portion 40, the pin 200 protrudes through the pin through hole 72 of the bollard 20 and into the concavity 132 of the sleeve 120.

In addition, the external surface 142 of the sleeve 120 is provided with surface features that are used to securely anchor the sleeve within the ground 2. In particular, the surface features include outwardly protruding annular beads 134, 136, 138 that extend about a circumference of the sleeve 120. In the illustrated embodiment, the sleeve includes a first bead 134 disposed adjacent to the first end 124, a second bead 138 disposed at the second end 138, and a third bead 136 disposed approximately mid-way between the first and second beads 134, 138. In addition, the concavity 132 protrudes outward from the sleeve sidewall 126, thus serving as a key to both anchor the sleeve within the ground 2 and prevent rotation of the sleeve within the ground 2.

In use, the sleeve 120 is embedded in the ground 2 using concrete such that the first end 124 of the sleeve 120 is generally flush with the ground surface 4. In addition, the insert 60 is inserted into the first end 22 of the bollard 20. During this insertion step, the pin 200 is manually pressed inward so that the insert 60 can be inserted into the bollard second end 22. The insert 60 is inserted Tinto the bollard 20 until the flange 78 abuts the bollard second end 22 and the pin 200 is permitted to protrude through the bollard through hole 32. In this configuration, the insert 60 is retained within the bollard first portion 36 through the engagement of the pin 200 in the bollard through hole 32 (FIG. 4). Next, the bollard first portion 36 is inserted into the sleeve 120. Again, the pin 200 is manually pressed inward relative to the bollard sidewall 26 so that the bollard 20 can be inserted into the sleeve 120. The bollard 20 is inserted into the sleeve 120 until the bollard first end 22 abuts the sleeve second end 122 and the pin 200 is permitted to protrude through the bollard through hole 32 and into the sleeve concavity 132. In this configuration, the bollard 20 and insert 60 are retained within the sleeve 120 through the engagement of the pin 200 in the sleeve concavity 132. In the assembled configuration, the breakaway line 34 is generally aligned with the closed face 66 of the insert 60, and the first end 124 of the sleeve 120 is generally aligned with the breakaway line 34. In general, the distance of the breakaway line 34 from the bollard first end 22 is greater than or equal to the sleeve axial length, where the sleeve axial length corresponds to the distance between the sleeve first end 124 and sleeve second end 122. The resulting bollard assembly 10 is securely installed in the ground 2 as shown in FIG. 1.

Figure 2:
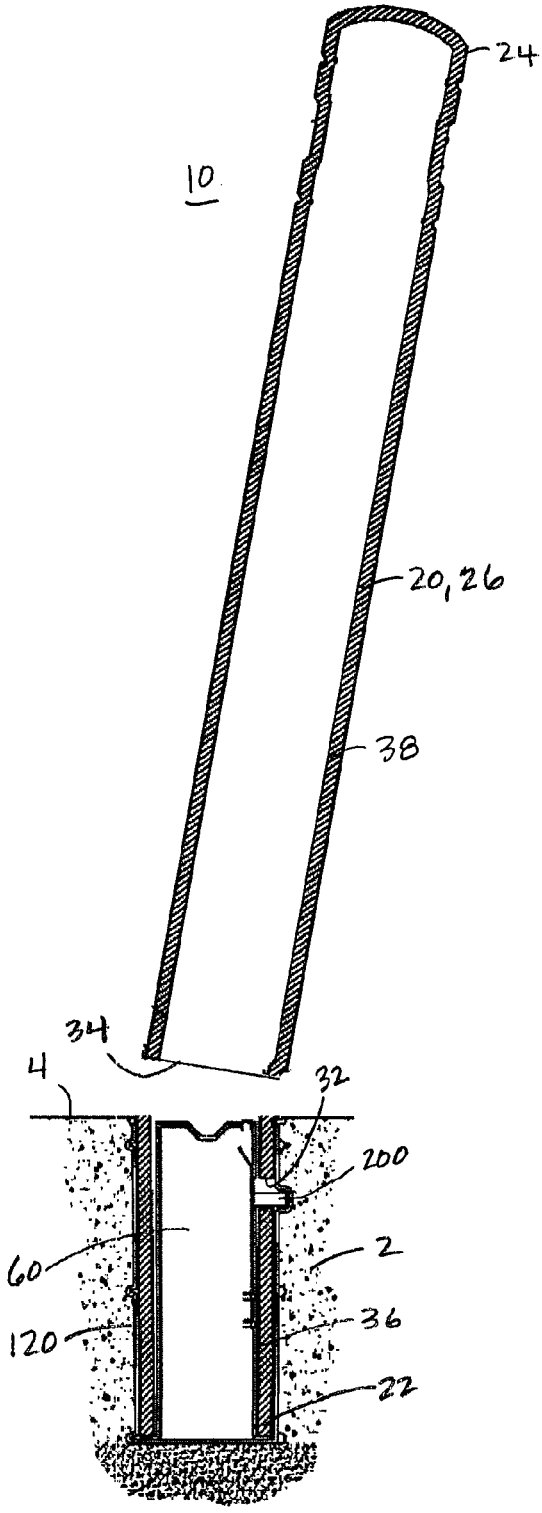
FIG. 2 is a sectional view of the bollard assembly after a portion of the bollard is broken off along a prescribed breakaway line.

In the event that the bollard 20 is damaged, the second portion 38 of the bollard can be removed by separating the bollard first and second portions 36, 38 along the breakaway line 34. Once the second portion 38 is removed from the installed bollard assembly 10, the closed end face 66 of the insert 60 is accessible (FIG. 2). The bollard first portion 36 and insert 60 can be removed from the sleeve 120 by removing the plug 86 from the insert key hole 84 (FIG. 10), and inserting a key (not shown) through the keyhole 84 to engage the angled portion 256 of the resilient plate 250, whereby the pin 200 is retracted from the sleeve concavity 132. While the pin 200 is retracted, the insert handle 82 is grasped permitting the insert 60 and bollard first portion 36 to be withdrawn from the sleeve 120. The embedded sleeve 120 remains in place in the ground 2, and can be used to receive a replacement bollard and insert subassembly.

A selected illustrative embodiment of the invention is described above in some detail. It should be understood that only structures considered necessary for clarifying the present invention have been described herein. Other conventional structures, and those of ancillary and auxiliary components of the system, are assumed to be known and understood by those skilled in the art. Moreover, while a working example of the present invention has been described above, the present invention is not limited to the working example described above, but various design alterations may be carried out without departing from the present invention as set forth in the claims.

For example, although the breakaway line 34 is formed as a V-shaped groove in the illustrated embodiment, the bollard 20 is not limited to this configuration. For example, the prescribed line can be formed by replacing the circumferential V-shaped groove with a circumferential perforation line or by using a material in the vicinity of the breakaway line that is weak relative to the remainder of the bollard.

What is claimed is:

1. A bollard assembly comprising a hollow bollard having a first end, a second end opposed to the first end, and a sidewall extending between the first end and the second end, a sleeve including a top end, a bottom end, and an interior surface, the sleeve configured to enclose a portion of the bollard sidewall, and an insert having an top end, a bottom end, and an insert sidewall, the insert disposed within the first end of the hollow bollard, wherein the sleeve is disposed on the first end of the bollard and the bollard sidewall further comprises a prescribed breakaway line, aligned with the top end of the sleeve and the top end of the insert, along which a portion of the bollard is configured to separate from the remainder of the bollard upon application of a sufficient load to the portion.

2. The bollard assembly of claim 1 wherein the hollow bollard further comprises a through hole formed in the side wall and the insert further comprises a pin protruding outward from the insert sidewall and extending through the bollard through hole, the pin being engaged with the sleeve interior surface.

3. The bollard assembly of claim 1 wherein the breakaway line is an annular portion of the bollard sidewall formed to be relatively weak when compared to the remainder of the bollard sidewall.

4. The bollard assembly of claim 1 wherein the breakaway line comprises an annular groove formed in the bollard sidewall.

5. The bollard assembly of claim 1 wherein the breakaway line is located between the first end of the bollard and a point disposed mid way between the first and second ends of the bollard.

6. The bollard assembly of claim 1 wherein the sleeve includes a sleeve first end, and a sleeve second end opposed to the sleeve first end, and the first end of the sleeve is aligned with the breakaway line.

7. The bollard assembly of claim 1 wherein the sleeve has a sleeve first end, a sleeve second end, and an axial length determined by the distance between the sleeve first end and sleeve second end, and the distance of the breakaway line from the bollard second end is greater than or equal to the sleeve axial length.

8. The bollard assembly of claim 2 wherein the sleeve includes a sleeve sidewall having a concavity configured to receive the insert pin, and when the pin protrudes through the bollard through hole and is received within the concavity, the pin engages the sleeve, and the bollard, sleeve, and insert are substantially prevented from relative movement.

9. The bollard assembly of claim 2 wherein the pin is configured to move relative to the insert in a direction generally transverse to a longitudinal axis of the insert, whereby the pin can be selectively retracted from engagement with the sleeve interior surface.

10. The bollard assembly of claim 9 wherein the insert includes a key hole configured to receive a pin retracting tool.

11. The bollard assembly of claim 2 wherein the insert further includes a resilient member configured to bias the insert pin in a radially outward direction.

12. The bollard assembly of claim 1 wherein the bollard is tapered in the vicinity of the first end.

13. The bollard assembly of claim 1 wherein the bollard is tapered between the prescribed breakaway line and the first end such that the outer diameter of the bollard at the breakaway line is greater than the outer diameter of the bollard at the first end.

14. The bollard assembly of claim 1 wherein the insert further includes a stop member configured to limit the extent to which the insert is inserted within the bollard.

15. The bollard assembly of claim 1 wherein the insert further includes a first end and a second end opposed to the first end, the second end including an outwardly protruding peripheral flange, the flange having an outer diameter that corresponds to the outer diameter of the bollard first end.

16. The bollard assembly of claim 1 wherein the insert includes a handle configured to permit the insert to be grasped and withdrawn from the sleeve.

17. The bollard assembly of claim 1 wherein the sleeve is a hollow, generally cylindrical body having an open first end, a closed second end, and a sidewall extending between the first and second ends, the sidewall including an outwardly protruding circumferential bead.

18. The bollard assembly of claim 2, wherein the pin is retractable relative to the insert sidewall.

19. The bollard assembly of claim 18 wherein the insert includes a key hole configured to receive a pin-retracting tool.

* * * * *